US009169651B1

(12) United States Patent
Wynne

(10) Patent No.: US 9,169,651 B1
(45) Date of Patent: Oct. 27, 2015

(54) STAIRWAY SYSTEM HAVING AN IMPROVED BALUSTER ASSEMBLY

(75) Inventor: David J. Wynne, Abingdon, VA (US)

(73) Assignee: ECMD, Inc., North Wilkesboro, NC (US)

( * ) Notice: Subject to any disclaimer, the term of this patent is extended or adjusted under 35 U.S.C. 154(b) by 224 days.

(21) Appl. No.: 13/532,833

(22) Filed: Jun. 26, 2012

(51) Int. Cl.
*E04F 11/18* (2006.01)

(52) U.S. Cl.
CPC ..... *E04F 11/1834* (2013.01); *E04F 11/1812* (2013.01)

(58) Field of Classification Search
CPC ..... E04F 11/1834; E04F 11/1812; E04F 11/1817; E04F 11/1814; E04F 2011/1817; Y10S 256/02; E04H 17/1421
USPC ..... 256/59, 67, 65.04–65.06, 65.14; 52/720.2, 832
See application file for complete search history.

(56) References Cited

U.S. PATENT DOCUMENTS

| | | | | |
|---|---|---|---|---|
| 4,505,456 | A | 3/1985 | Zieg | 256/67 |
| 4,928,930 | A * | 5/1990 | Chung | 256/67 |
| 5,340,087 | A * | 8/1994 | Turner | 256/67 |
| 5,419,538 | A | 5/1995 | Nicholas et al. | 256/65 |
| 5,437,433 | A * | 8/1995 | Rezek | 256/67 |
| 5,547,169 | A | 8/1996 | Russell | 256/67 |
| 5,584,469 | A | 12/1996 | Goodwin | 256/65 |
| 5,695,175 | A | 12/1997 | Hawkins | 256/67 |
| 6,145,814 | A | 11/2000 | Perrot | 256/67 |
| 6,769,221 | B1 | 8/2004 | Green | 52/720 |
| 7,159,363 | B1 | 1/2007 | Green et al. | 52/184 |
| 7,178,791 | B1 * | 2/2007 | Gray et al. | 256/67 |
| 7,421,824 | B1 | 9/2008 | Green | 52/182 |
| 7,614,612 | B2 * | 11/2009 | Edwards | 256/67 |
| 7,621,510 | B2 * | 11/2009 | Gibbs et al. | 256/22 |
| 7,779,582 | B1 * | 8/2010 | Green | 52/182 |
| 7,896,318 | B1 * | 3/2011 | Gibbs et al. | 256/67 |
| 7,909,311 | B2 * | 3/2011 | Edwards | 256/67 |
| 7,971,412 | B1 * | 7/2011 | Lim | 52/832 |
| D667,964 | S * | 9/2012 | Chung | D25/133 |
| 8,376,321 | B2 * | 2/2013 | Dotsey | 256/65.07 |
| 8,424,850 | B2 * | 4/2013 | Bennette | 256/65.05 |
| 8,936,233 | B1 * | 1/2015 | Sneith | 256/67 |
| 2007/0246698 | A1 * | 10/2007 | Truckner et al. | 256/67 |
| 2008/0173857 | A1 * | 7/2008 | Edwards | 256/67 |
| 2009/0278106 | A1 * | 11/2009 | Truckner | 256/67 |
| 2011/0167740 | A1 | 7/2011 | Truckner | 52/191 |
| 2013/0175488 | A1 * | 7/2013 | Burt et al. | 256/65.04 |
| 2013/0214228 | A1 * | 8/2013 | Sneith | 256/65.07 |
| 2013/0328004 | A1 * | 12/2013 | Truckner | 256/65.01 |
| 2014/0054530 | A1 * | 2/2014 | Petta | 256/67 |

OTHER PUBLICATIONS

Sheraton Catalog; undated, related technology.
Crown Heritage Stair Systems Catalog; copyright 2000.
(Continued)

*Primary Examiner* — Joshua Kennedy
(74) *Attorney, Agent, or Firm* — MacCord Mason PLLC

(57) ABSTRACT

A stairway system. The stairway system includes a plurality of spaced apart treads, a handrail and a baluster assembly. The baluster assembly includes at least one baluster per tread. The baluster includes at least one rake anchor adapted to abut the angled support surface of the handrail adjacent to one end of the baluster, a rake shoe adapted for concealing the interface between the rake anchor and the angled support surface of the handrail and an anchor assembly including an anchor adapted for receiving the other end of the baluster. The stairway system further includes a handrail support for supporting the handrail.

11 Claims, 14 Drawing Sheets

(56) References Cited

OTHER PUBLICATIONS

Creative Stairparts; copyright 1998.
L.J. Smith Catalog; copyright 1997.
Coffman Catalog; copyright 1995.
Horner Architectural Products Catalog; copyright 2000.
Brochure "the transformer system" Baluster replacement made easy; 0/304/10.

* cited by examiner

STAIRWAY SYSTEM HAVING AN IMPROVED BALUSTER ASSEMBLY

BACKGROUND (1) Field

The present inventions relate generally to stairway systems and, more particularly, to an improved baluster assembly for stairway systems.

(2) Related Art

Stairway systems typically provide a series of balusters, treads and a handrail. The balusters may include aesthetic aspects, such as features that align with both the tread and the handrail. Thus, replacing and retrofitting balusters on existing stairways is often a difficult and expensive endeavor.

One common disadvantage with conventional replacement stairway systems and baluster assemblies is that they are often complicated to arrange and install. For example, traditional designs typically require substantial decision-making and a heightened mechanical aptitude. Accordingly, an installer may have to determine which components to install, where and how to plug existing holes in the treads and handrails, and in some cases, to require physical modification of components.

Thus, there remains a need for a new and improved stairway system and baluster assembly that is adapted to be installed easily in a large variety of existing and new structures without the need for skilled workers while, at the same time, conceals details of its construction to provide an aesthetically pleasing final result.

SUMMARY OF THE INVENTIONS

The present inventions are directed to a stairway system. The stairway system includes a plurality of spaced apart treads, a handrail and a baluster assembly. The baluster assembly includes at least one baluster per tread. The baluster includes at least one rake anchor adapted to abut the angled support surface of the handrail adjacent to one end of the baluster, a rake shoe adapted for concealing the interface between the rake anchor and the angled support surface of the handrail and an anchor assembly including an anchor adapted for receiving the other end of the baluster. The stairway system further includes a handrail support for supporting the handrail.

The anchor is adapted to receive the other end of the baluster on its installation face. In one embodiment, the anchor is generally U-shaped. The anchor may have an open boxed shaped cross-section.

In one embodiment for attachment to the top of a tread, the anchor further includes a base and a fastener for attaching the base to the top surface of the tread. The base may be convex-shaped to be received by a pre-existing plughole in the tread thereby self-aligning within the pre-existing plughole. In addition, the anchor assembly may further include a shoe adapted for concealing the interface between the anchor and the other end of the baluster attached to the tread.

The rake shoe adapted for concealing the interface between the rake anchor and the angled support surface of the handrail may be pivotally attached to the rake anchor. In one embodiment, the upper surface of the rake anchor forming the interface between the rake anchor and the angled support surface of the handrail is French curve-shaped for pivoting with respect to the angled support surface of the handrail.

The stairway system may further include an adapter for receiving the end of the at least one baluster opposite from the end received by the anchor. In one embodiment, the adapter is a wedge formed into a generally inverted cup-shape.

In another embodiment for attachment to the top of a kneewall, the anchor further includes an angled base and a fastener for attaching the angled base to the top surface of the kneewall. The angled base may further include at least one relief such as a notch, centered hole or crease to allow the angled base to bend to conform to the angle of the top surface of the kneewall. Also in an embodiment for attachment to the top of a kneewall, the anchor assembly may further include a rake anchor adapted to abut the kneewall adjacent to the other end of the baluster and a rake shoe adapted for concealing the interface between the rake anchor and the other end of the baluster attached to the kneewall.

In one embodiment, the handrail support is a newel. One end of the newel may be connected to the handrail and the other end of the newel may be anchored. The newel may be connected to the ends of the handrail. The newel may be vertically anchored. The newel may be anchored to the floor of the structure. The newel also may be anchored to at least one tread.

The spaced apart treads may include a foot support surface and means for attaching the foot support surface to the structure. The width of the foot support surface may be greater than the depth of the foot support surface. The means for attaching the spaced apart treads to the structure may include stringers, routed skirtboards and combinations thereof. Also, the means for attaching the spaced apart treads to the structure may be by wall mounting.

The spaced apart treads may be spaced at a uniform riser height. The uniform riser height may vary between about 6" and about 9". In one embodiment, the uniform riser height is about 7½".

In one embodiment of the stairway system, at least one baluster is metal. The balusters may include a generally uniform cross section substantially along its entire length. In another embodiment, the balusters may include a top length segment, a bottom length segment and a design feature segment, the design feature segment including a defined feature. The stairway system may include at least one subsequent baluster per tread. Each of the features in the design feature segment of each of the balusters may align with the angled support surface of the handrail, i.e. is aligned from the top with respect to the handrail. Also, the combined length of the top length segment, design feature segment and bottom length segment of the baluster is between about 24" and about 46".

Accordingly, one aspect of the present inventions is to provide a stairway system, the stairway system including (a) a plurality of spaced apart treads; (b) a handrail; and (c) at least one baluster per tread, the baluster having (i) at least one rake anchor adapted to abut the angled support surface of the handrail adjacent to one end of the baluster and (ii) a rake shoe adapted for concealing the interface between the rake anchor and the angled support surface of the handrail.

Another aspect of the present inventions is to provide a baluster assembly for a stairway system having a plurality of spaced apart treads and a handrail, the improvement including (a) at least one baluster per tread, the baluster having (i) at least one rake anchor adapted to abut the angled support surface of the handrail adjacent to one end of the baluster and (ii) a rake shoe adapted for concealing the interface between the rake anchor and the angled support surface of the handrail; and (b) an anchor assembly including an anchor adapted for receiving the other end of the baluster.

Still another aspect of the present inventions is to provide a stairway system, the stairway system including (a) a plurality of spaced apart treads; (b) a handrail; (c) a baluster assembly, the baluster assembly including at least one baluster per tread, the baluster having (i) at least one rake anchor adapted to abut the angled support surface of the handrail adjacent to one end of the baluster, (ii) a rake shoe adapted for concealing the interface between the rake anchor and the angled support surface of the handrail and (iii) an anchor assembly including an anchor adapted for receiving the other end of the baluster; and (d) a handrail support for supporting the handrail.

These and other aspects of the present inventions will become apparent to those skilled in the art after a reading of the following description when considered with the drawings.

DESCRIPTION OF THE EMBODIMENTS

Figure 1:
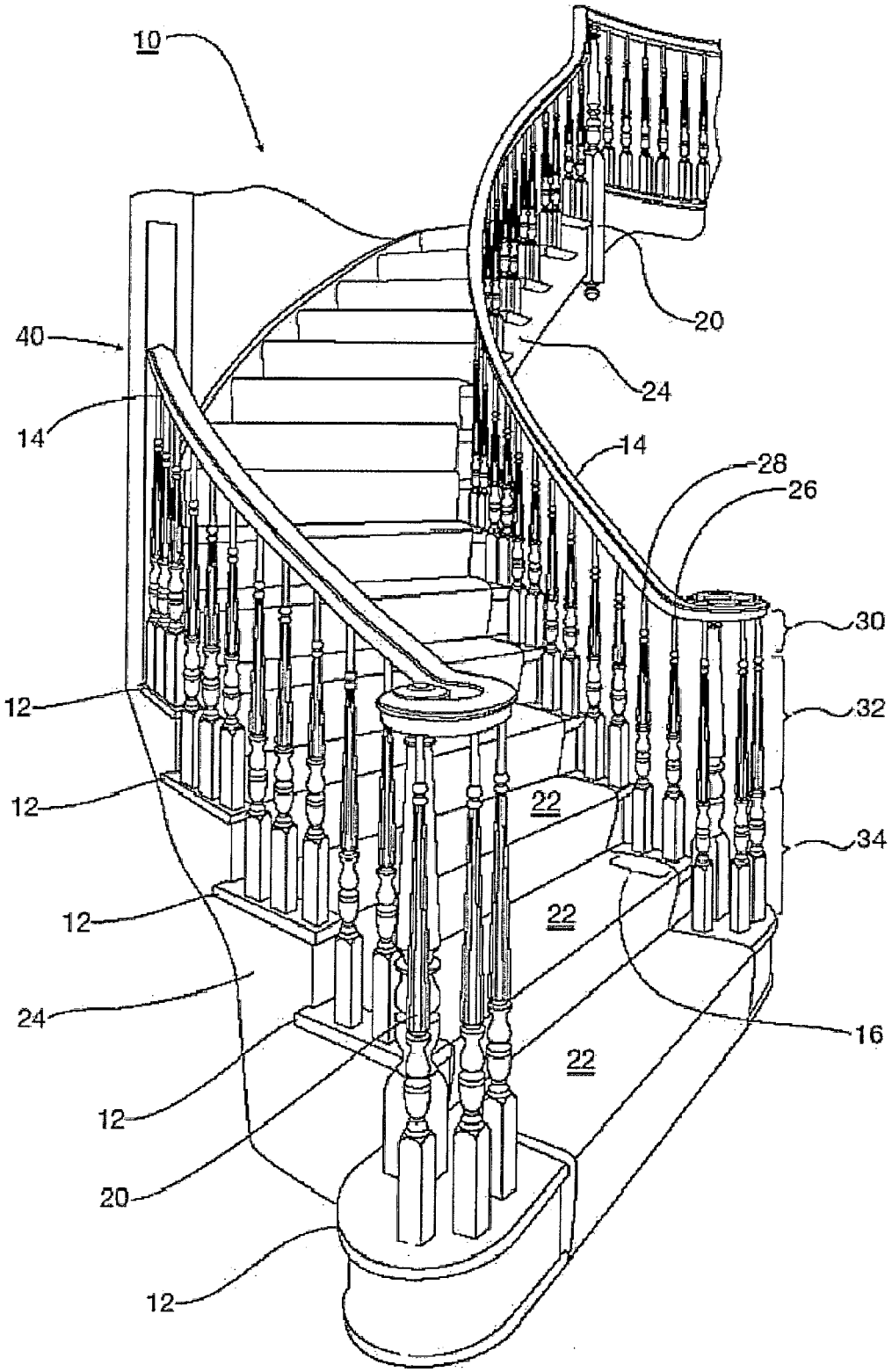
FIG. 1 (PRIOR ART)
FIG. 1 is a prior art stairway system for the purpose of illustrating various components typical to be founding embodiments herein.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 3:
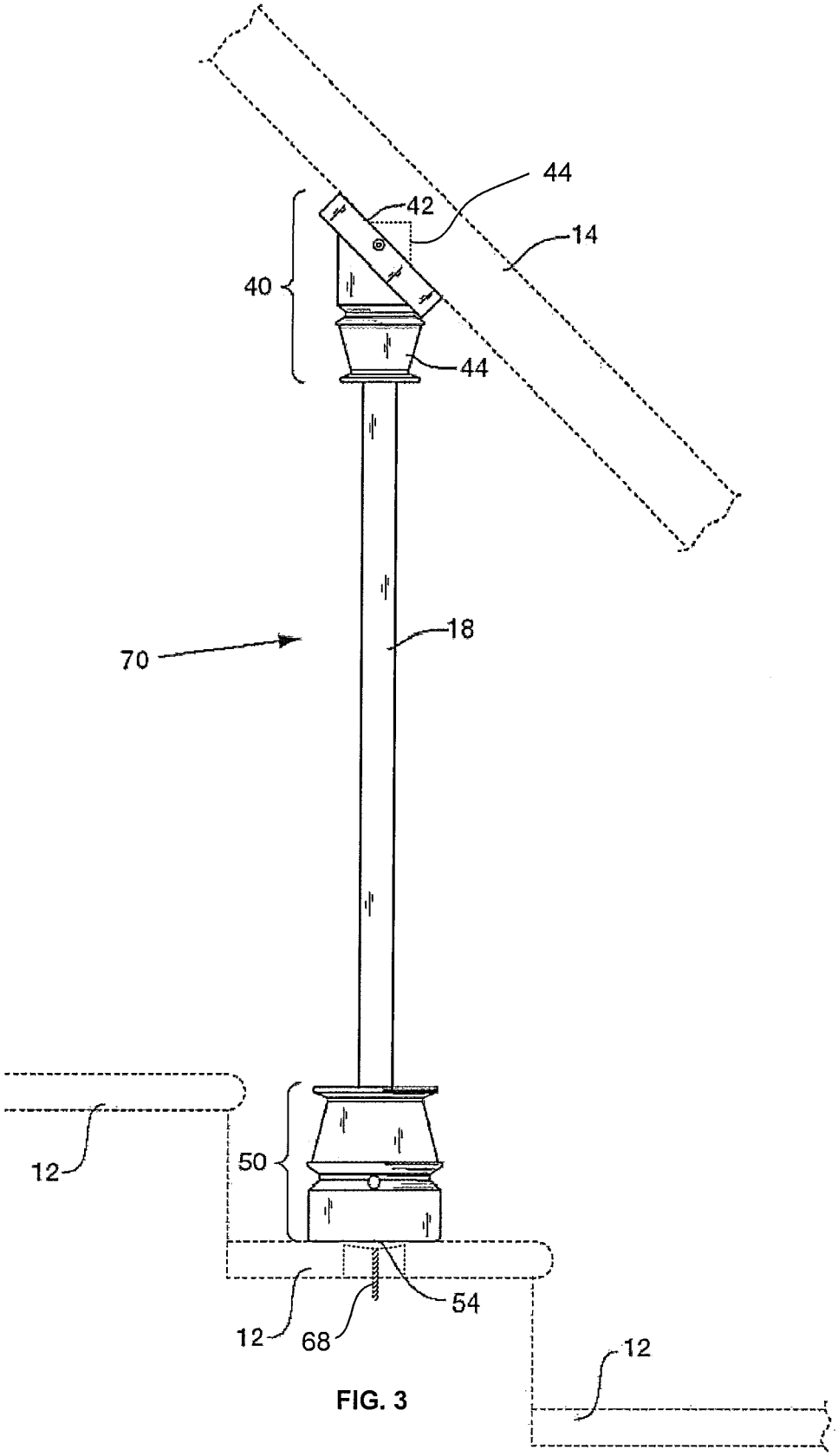
FIG. 3 is a side perspective view of a baluster assembly for an open tread stairway system constructed according to one embodiment of the present inventions, with elements shown in phantom for clarity.
Figure 10:
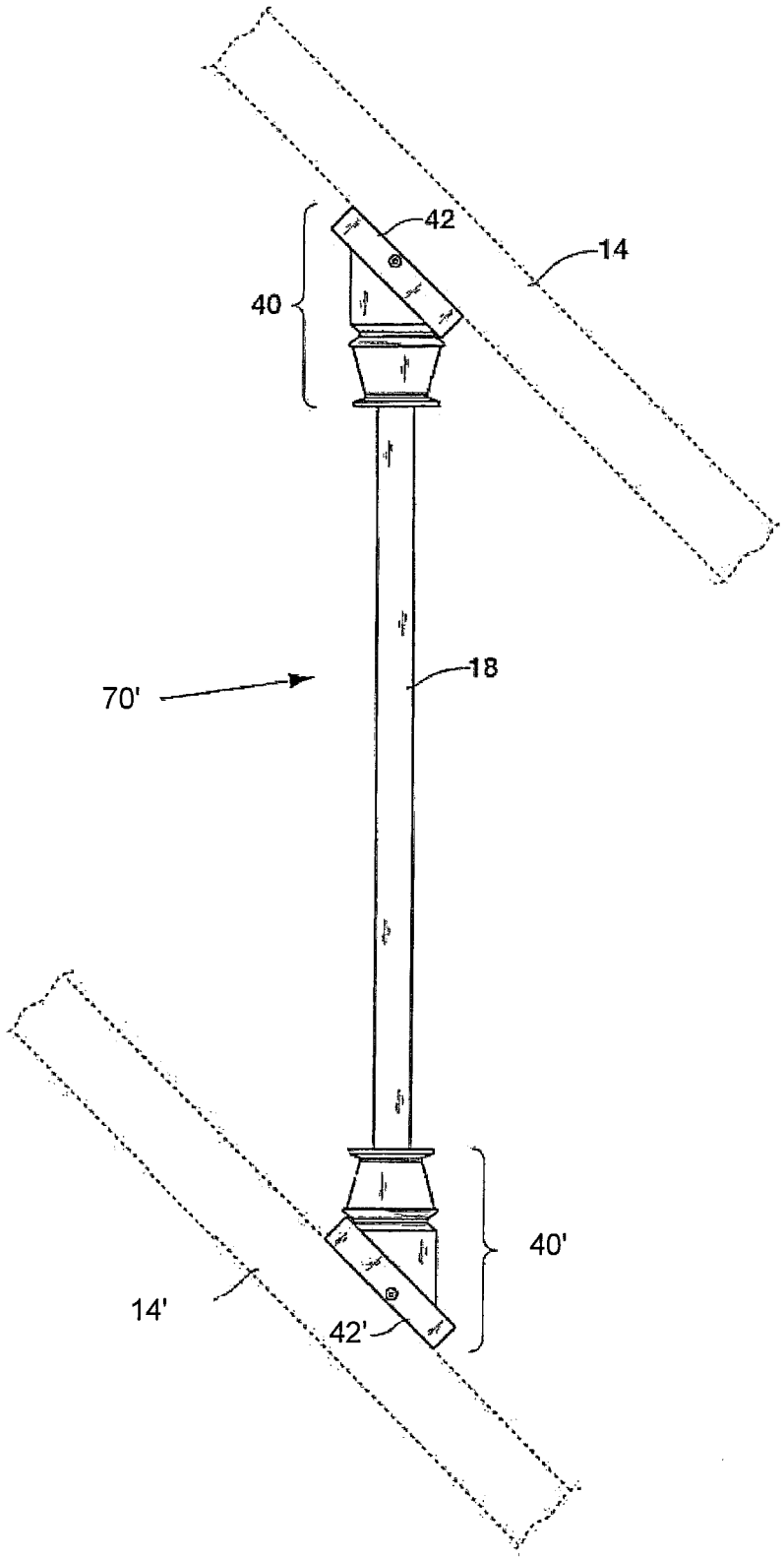
FIG. 10 is a side perspective view of a baluster assembly for a kneewall stairway system constructed according to one embodiment of the present inventions, with elements shown in phantom for clarity.

Referring now to the drawings in general and FIGS. 1, 3 and 10 in particular, it will be understood that the illustrations are for the purpose of describing embodiments of the inventions and are not intended to limit the inventions thereto. As best seen in FIG. 1, a prior art stairway system, generally designated 10, is shown for the purpose of illustrating various components typical to be found in embodiments herein. The stairway system 10 includes three major sub-assemblies: a plurality of spaced apart treads 12; a handrail 14; and at least one baluster per tread 16.

Any of the baluster embodiments herein may include a top length segment, a design element segment and a bottom length segment. The spaced treads 12 include a foot support surface 22. Typically, the width of the tread is greater than the depth of the tread. There is a means for attaching 24 the stairway system to a structure. One method includes a stringer. Other methods are wall supports or floor supports. The handrail 14 is separated from the spaced treads 16 by a lateral support 20. Various types of lateral supports might be included, including a newel.

Typically, the riser height is uniform and ranges from about 6" and about 9". Within the United States the riser height more typically is designated at about 7½".

Balusters may have a uniform cross-section along their entire length but, it is also common for a baluster to include a top length segment 30, a design element segment 32 and a bottom length segment 34. In systems using a plughole, it is particularly desirable to have the top length segment 30 align from baluster to baluster and with the handrail 14, while the bottom length segment 34 aligns from baluster to baluster and with the tread. However, in iron systems, the location of the design element segment 32 is typically aligned from the handrail, i.e. is top down, instead of tread up.

In creating or remodeling a stairway system 10 of the present inventions, it may be advantageous to assemble, replace and/or relocate balusters, particularly in open stair systems, knee wall systems and in balcony systems.

Figure 2A:
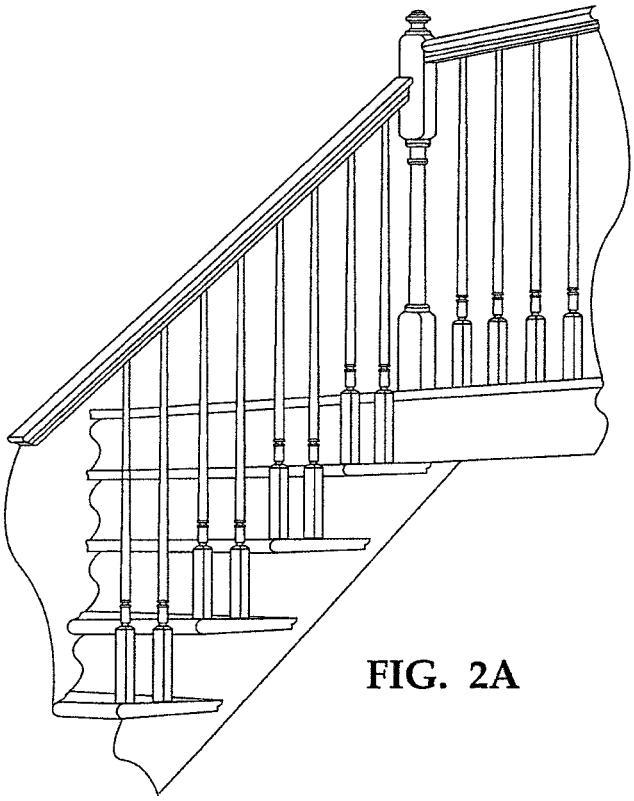
FIG. 2A is an isolated portion a conventional open tread stairway system.
Figure 2B:
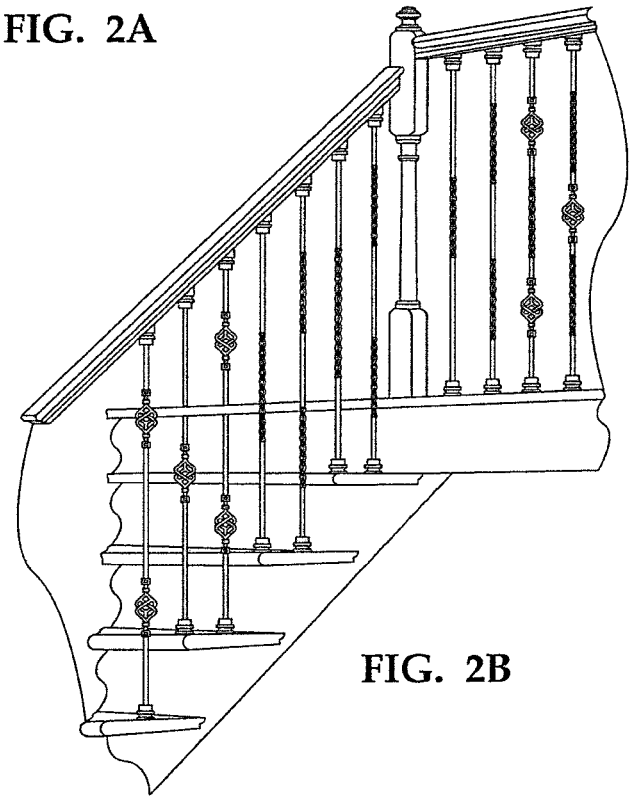
FIG. 2B is an isolated portion an open tread stairway system constructed according to one embodiment of the present inventions.

FIG. 2A is an isolated portion of a conventional open tread stairway system. FIG. 2B is an isolated portion of an open tread stairway system constructed according to one embodiment of the present inventions shown for comparison. The construction of the stairway system shown in FIG. 2B can best be understood by turning to FIG. 3.

FIG. 3 is a side perspective view of a baluster assembly for an open tread stairway system constructed according to one embodiment of the present inventions, with elements shown in phantom for clarity. As seen in FIG. 3, one embodiment of a baluster assembly for an open tread, generally designated 70, is shown constructed according to the present inventions. Baluster assembly 70 includes three major sub-assemblies: anchor assembly 50; a rake anchor 40; and a baluster, for instance a baluster generally indicated as 18. However, other embodiments of balusters, or baluster feasters, may include any of the balusters, or baluster features, shown and described herein.

Figure 4:
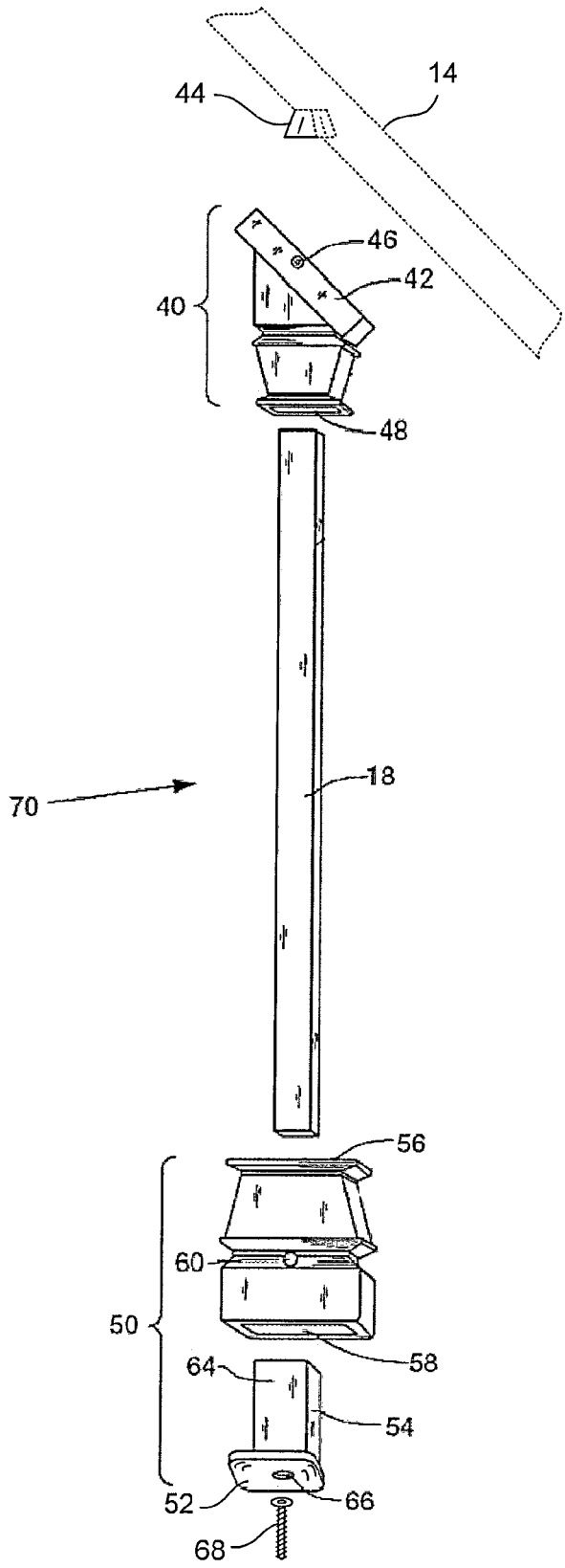
FIG. 4 is a perspective exploded view of a baluster assembly embodiment as shown in FIG. 3.

As introduced in FIG. 4, one embodiment of anchor assembly 50 includes a self-aligning base and an anchor. In this particular embodiment, the anchor includes a mounting void 66 and is generally adapted to be secured to tread 12, foot support surface 22 or the like, with a wood screw 68 or similar engaging fastener such as a molly bolt. Typically, the self-aligning base slides over the anchor and is secured thereto with fastener 60. Examples of the self-aligning base include a first cavity 56 and an opposing second cavity 58, through which baluster 18, or the like, may protrude to anchor chamber 64 of anchor 54. In particular embodiments, baluster 18 includes a generally uniform cross-section as indicated 18.

As further introduced in FIG. 4, rake anchor 40 includes a rake shoe 42 that is typically adapted for securing an opposing end of baluster 18 to an angled support surface, for example an angled handrail or the like. Rake shoe 42 may be adjustable about rake anchor 40 with a pivot, for example one, or a pair, of pivoting dimples or fasteners 46, as indicated in FIG. 4. Further, rake anchor 40 may include an adapter 44 and a shoe aperture 48, which is sized and arranged to accept baluster 18 or the like. Adapter 44 may be generally shaped like the upper part of a generally, inverted cup-shape, for instance a salinon shape (i.e. four connected semicircles).

Figure 5:
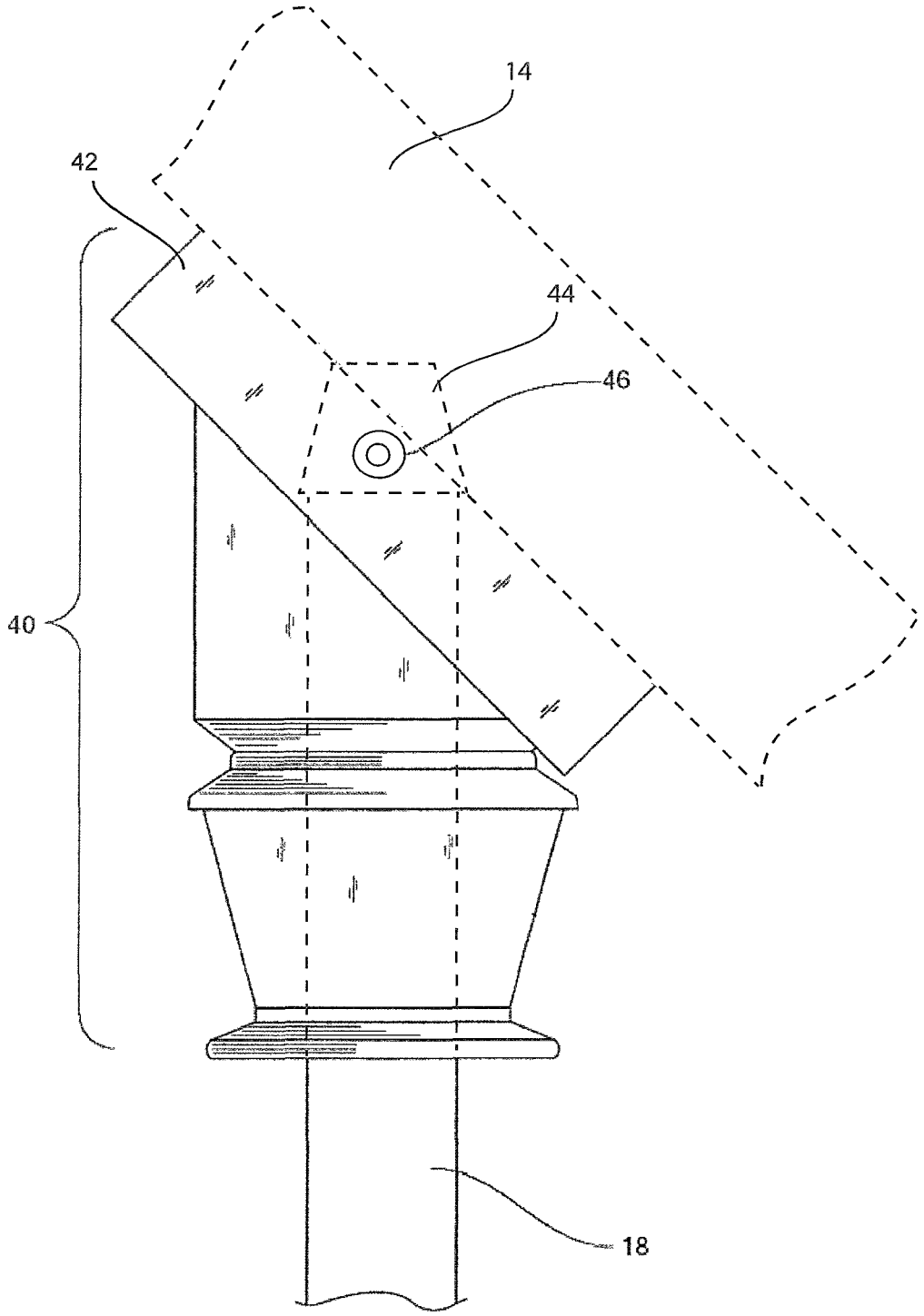
FIG. 5 is an enlarged isolated side perspective view of a rake anchor embodiment as shown in FIGS. 3 and 4, with elements removed for clarity with the portion in dotted lines showing the generally inverted cup-shape adapter for receiving the end of a baluster into a hole in the bottom of the handrail.

FIG. 5 illustrates an isolated view of one embodiment of rake anchor 40 securedly engaged with baluster 18. Typically, baluster 18 protrudes into an adapter described herein, and in particular, baluster 18 extends through shoe aperture 48. A fastener within a fastener cavity may secure baluster 18 within rake anchor 40. Rake shoe 42 is aligned on rake anchor 40 with pivot fastener 46, so that rake shoe 42 may pivot about fastener 46 to match the pitch of an angled support surface. In particular embodiments, rake shoe 42 pivots about fastener 46 as a self-aligning match with the angled pitch of handrail 14. In these embodiments, rake shoe 42 is intricately formed with rake anchor 40 to conceal an interface between rake anchor 40 and the angled support surface that is adjacent to one end of baluster 18.

Figure 6A:
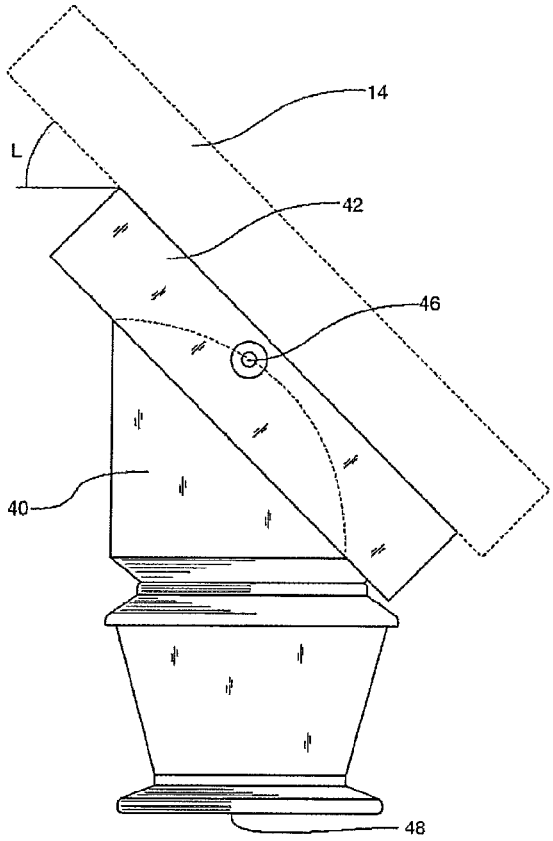
FIG. 6A is an enlarged isolated side perspective view of a rake anchor as introduced in FIG. 3, with a rake shoe aligned to match angle L of one angled support surface shown in phantom.
Figure 6B:
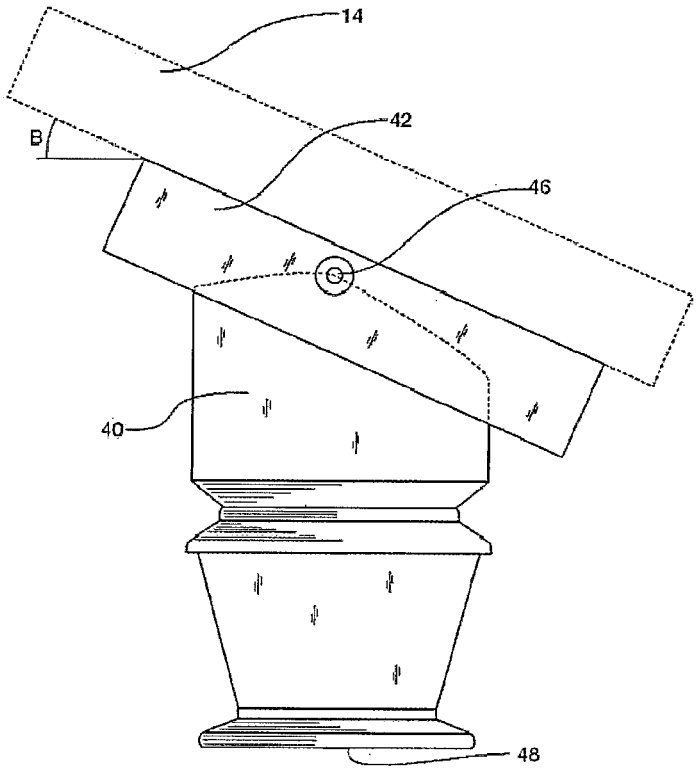
FIG. 6B is another enlarged isolated side perspective view of a rake shoe as introduced in FIG. 3, with a rake shoe aligned to match an angle B of a second angled support surface shown in phantom.

As indicated in FIGS. 6A and 6B, rake shoe 42 may pivot about fastener 46 into a variety of configurations, including a first position as shown in FIG. 6A and a second position as shown in FIG. 6B, to match the angled surface and/or to conceal the interface between rake anchor 40 and the angled support surface. In some embodiments, the upper surface of rake anchor 40 may be French curve-shaped for pivoting with respect to the angled support surface of the handrail. For instance, as shown in FIG. 6A, the French curve-shape of rake anchor 40 allows rake shoe 42 to match one angled pitch of handrail 14, herein indicated as angle L. Similarly, the French curve of rake anchor 40 allows rake shoe 42 to match another angle B of handrail 14, as illustrated in FIG. 6B. Other embodiments of rake anchor 40 include a variety of French curve configurations to enhance the adaptability and ease of retrofitting stairway system 10.

Figure 7:
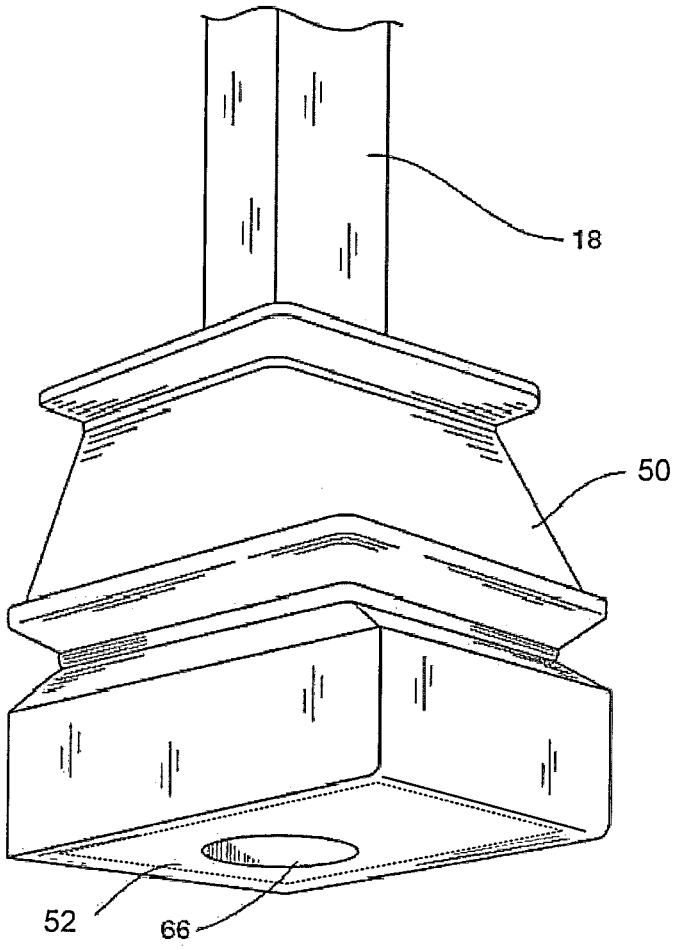
FIG. 7 is an enlarged isolated bottom perspective view of an anchor assembly embodiment as introduced in FIG. 3.

FIG. 7 shows a bottom perspective view of an assembled anchor assembly 50 embodiment. As shown, baluster 18 is securedly engaged with the anchor, which is thereby securedly engaged with self-aligning base 52. A fastener 68, such as a wood screw, molly bolt or the like, may extend through mounting void 66 to secure the anchor and thereby anchor assembly 50 to tread 12, or the like.

Figure 8A:
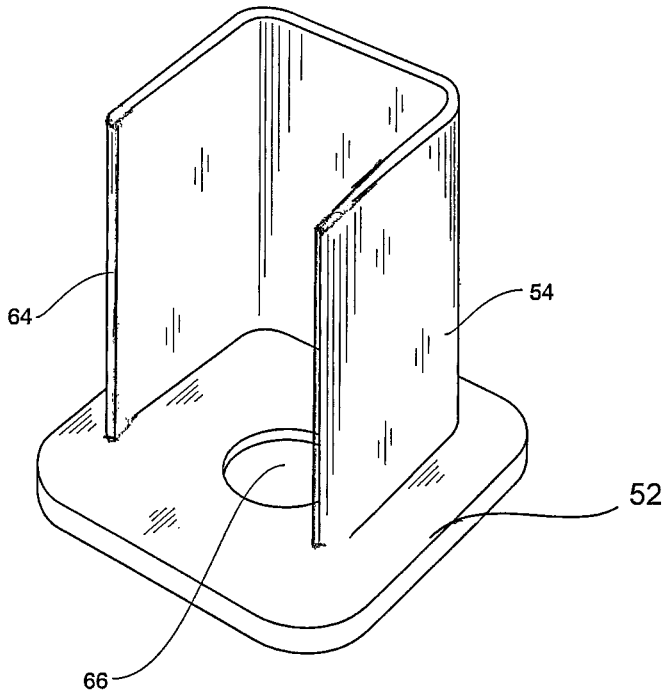
FIG. 8A is an enlarged isolated side perspective view of an anchor having a self-aligning base as introduced in FIG. 3.

FIG. 8A illustrates an isolated view of one embodiment of anchor 54. As shown, anchor 54 may include an anchor chamber 64 that is generally sized and arranged to accept and secure baluster 18, or the like. Anchor chamber 64 may include at least one open face, for example an installation face to allow access and positioning of baluster 18, or the like. In this particular embodiment, anchor 54 may have a generally U-shaped upper body section and a flat lower face that may be positioned and engaged on a tread, or the like. In this embodiment, anchor 54 may have an open boxed shaped cross-section. As shown in FIG. 8A, mounting void 66 may be positioned on the bottom face of anchor 54 and may be attached with a wood screw, molly bolt or similar fastener to tread 12, or the like. Other embodiments of anchor 54 include multi-mounting voids for multi-fasteners, and multi-open faces to allow further convenient access to baluster 18 and mounting to tread 12, or the like.

Figure 8B:
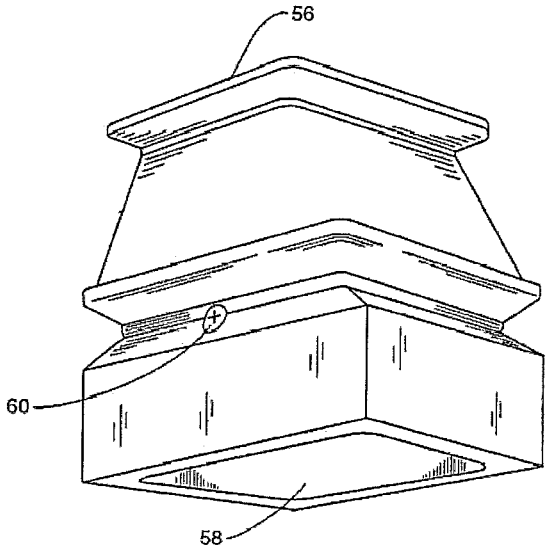
FIG. 8B is an enlarged isolated side perspective view of a shoe for an anchor having a self-aligning base as introduced in FIG. 3.

FIG. 8B illustrates an isolated view of one embodiment of a self-aligning base. As shown, the self-aligning base is typically a convex-shaped base, and may include a rigid body with closed sides and open opposing first cavity and second cavity 56, 58, respectfully. First cavity 56 and second cavity 58 are generally sized and configured to allow baluster 18, or the like, to pass through the self-aligning base to mate with anchor 54. Fastener 60 may be positioned within a fastener cavity on the self-aligning base to secure baluster 18 to the self-aligning base once the baluster 18, or the like, is in an installed position. Similar to embodiments of the rake anchor, the self-aligning base may also include an adapter portion with stylized, decorative features for enhanced aesthetics and uniformity along the tread, or the like. Other embodiments of anchor assembly 50 include other sizes and configurations to match the characteristics of baluster 18, existing systems and/or clearance constraints.

In additional embodiments, this disclosure includes a renovation or retrofit kit. In certain examples of this embodiment, the kit may include at least one anchor assembly 50, e.g. any of the anchor assemblies previously shown or described; and at least one rake anchor 40, e.g. any of the rake anchors previously shown or described. The kit may further include at least one baluster, e.g. any of the balusters previously shown or described. Other embodiments may incorporate existing balusters. Typically, these kits include materials for assembling, retrofitting or otherwise renovating an existing stairway system, and a baluster assembly in particular, as described above.

In one embodiment of operation for installation on an open tread, an installer first removes any existing wood balusters. One way is to use a pair of tree Toppers to cut the baluster at its smallest diameter, usually at the top, leaving a few inches below the handrail in order to work the short piece out of the bottom of the handrail. The rest of the baluster is then worked out of the tread and any nails are removed. Although the hole in the bottom of handrail and the plughole in the tread will be covered, the surrounding area should not be damaged.

Once all the balusters have been removed, the anchors are installed as follows, starting at the bottom of the stairs. The open side of the U-shaped anchor is positioned to face the riser of the next step. A wood screw is inserted into the anchor and the screw is started into the center of the plughole where the wood baluster has been removed. The screw is tightened securely with the anchor lined up squarely with the edges of the tread, but not over tightened since that could strip out the plughole. A molly bolt can also be used if the plughole is damaged or additional strength is desired. The base of the anchor is convex on the bottom to self-align and center itself on the plughole. The installer then continues up the stairs until all the anchors have been installed.

Next, the installer first measures from the inside of the anchor to the lower side of the hole in the bottom of the handrail. Then, the installer transfers this measurement from the shoulder of the baluster and marks the length. The baluster is cut with a hacksaw or a power miter box with a metal abrasive cut off blade.

The balusters will be progressively longer from front to back on each tread. The balusters should be cut from long to short so if a cut is missed, the baluster can still be used by cutting it shorter for the next plughole. Depending on accuracy of the original installation, the baluster lengths may not be the same on each tread, so each length should be measured before cutting the next baluster.

The installer now slides the rake shoe on the top of the baluster with the setscrew facing the same side as the one on the tread shoe. The installer places the adapter on the top of the baluster above the rake shoe. The baluster top adapters may be either ⅝ inch or ¾ inch in diameter, depending on the size of the hole in the bottom of the handrail. The installer will choose the one that fits best.

Starting from the bottom of the stairs, the installer picks the assembly up and slides the tread shoe up a few inches from the bottom of the baluster in order to be able to slide the baluster into the anchor. The side of the shoe with the setscrew should face the next riser up the stairs so the setscrew will not be noticeable in the final installation. The installer slides the top of the baluster with the adapter on top into the hole in the bottom of the handrail and swings the bottom of the baluster into the anchor.

Once in place, the shoe is lowered down over the anchor. If needed, the installer can push the baluster up slightly so the baluster shoulder is up to the rail on the lower side. The setscrew is now tightened on the shoe. The installer next pushes the rake shoe up against the bottom of the handrail, adjusts the top lines up with the handrail and tightens the other setscrew. The installer repeats this process for the next baluster and works up the stairs. Other embodiments include other variations of operations as described above.

Figure 9A:
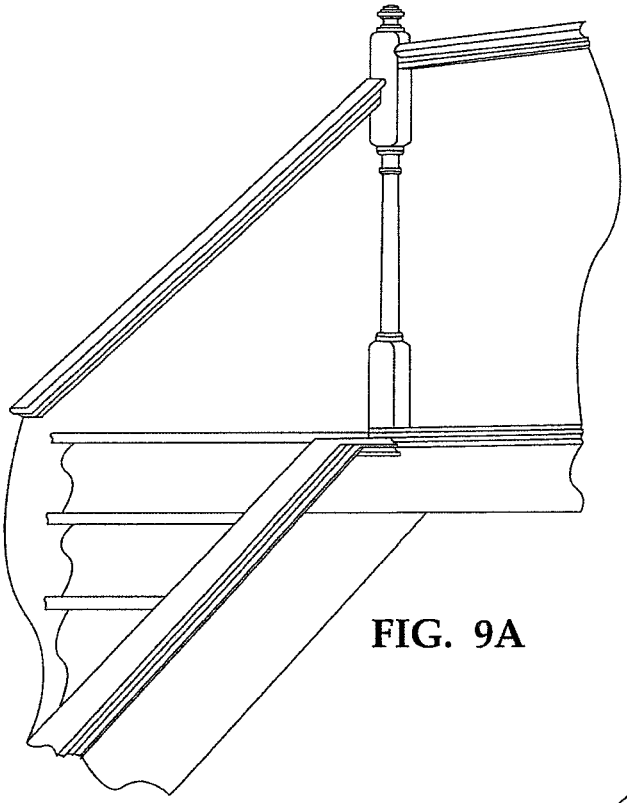
FIG. 9A is an isolated portion a conventional kneewall stairway system.
Figure 9B:
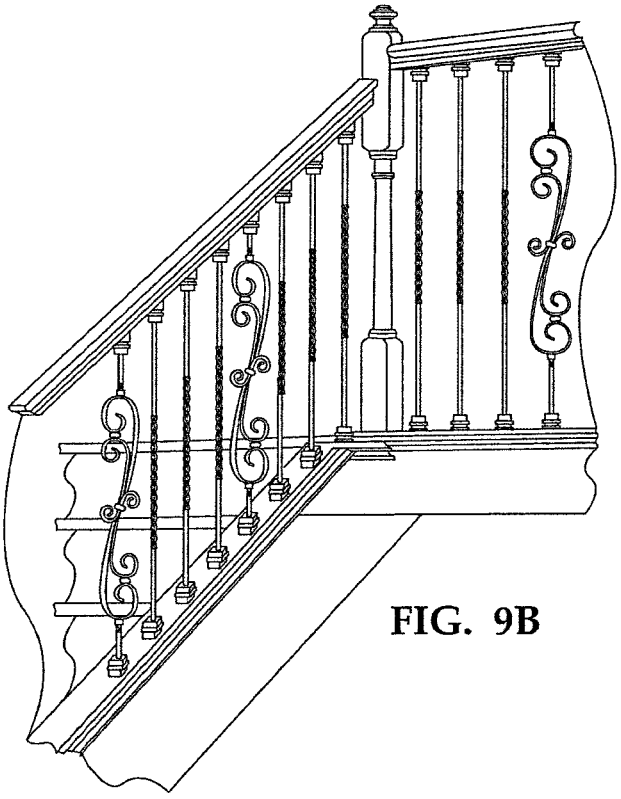
FIG. 9B is an isolated portion a kneewall stairway system constructed according to another embodiment of the present inventions.

Turning now to FIG. 9A there is shown an isolated portion a conventional kneewall stairway system. FIG. 9B is an isolated portion a kneewall stairway system constructed according to another embodiment of the present inventions shown for comparison. The construction of the stairway system shown in FIG. 9B can best be understood by turning to FIG. 10.

FIG. 10 is a side perspective view of a baluster assembly for a kneewall stairway system constructed according to one embodiment of the present inventions, with elements shown in phantom for clarity. As seen in FIG. 10, an embodiment of a baluster assembly for a kneewall, generally designated 70', is shown constructed according to the present inventions. Baluster assembly 70' includes three major sub-assemblies: an upper rake anchor 40; a lower rake anchor 40'; and a baluster, for instance a baluster generally indicated as 18. However, other embodiments of balusters, or baluster feasters, may include any of the balusters, or baluster features, previously shown and described.

Figure 11:
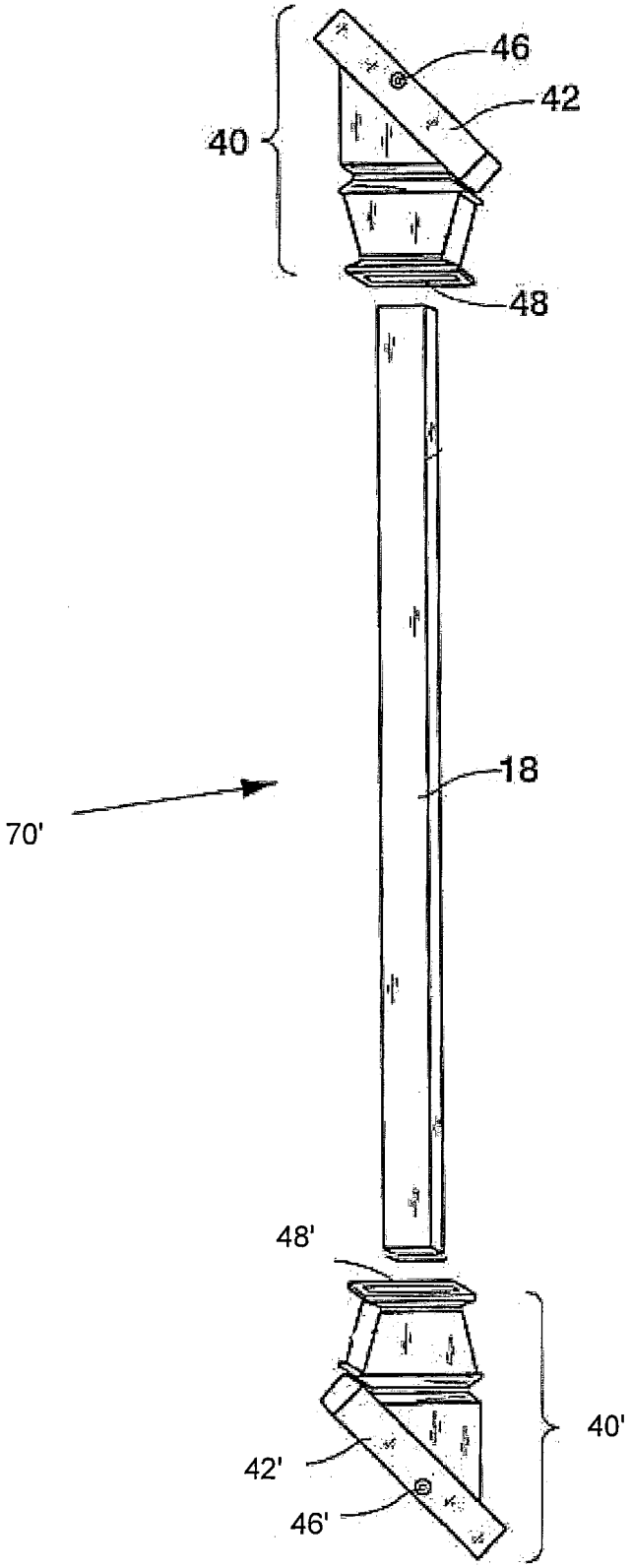
FIG. 11 is a perspective exploded view of a baluster assembly embodiment as shown in FIG. 10.

As introduced in FIG. 11, lower rake anchor 40' includes a rake shoe 42' that is typically adapted for securing an opposing end of baluster 18 to an angled support surface, for example an angled kneewall or the like. Rake shoe 42' may be adjustable about rake anchor 40' with a pivot, for example one, or a pair, of pivoting dimples or fasteners 46, as indicated in FIG. 11 and previously described herein. Further, rake anchor 40' may also include an adapter 44' and a shoe aperture 48, which is sized and arranged to accept baluster 18 or the like. Adapter 44' may be generally shaped like the upper part of a generally, inverted cup-shape, for instance a salinon shape (i.e. four connected semicircles.

As previously discussed above with respect to upper rake anchor 40 in FIG. 5, lower rake anchor 40' is securedly engaged with baluster 18 in substantially the same manner. As also previously indicated above with respect to upper rake anchor 40 in FIGS. 6A and 6B, lower rake shoe 42' may pivot about dimples 46' into a variety of configurations, including a first position as shown in FIG. 6A and a second position as shown in FIG. 6B, to match the angled surface and/or to conceal the interface between rake anchor 40' and the angled support surface. Similar to upper rake anchor 40, in some embodiments, the lower surface of lower rake anchor 40' also may be French curve-shaped for pivoting with respect to the angled support surface of the handrail.

Figure 12:
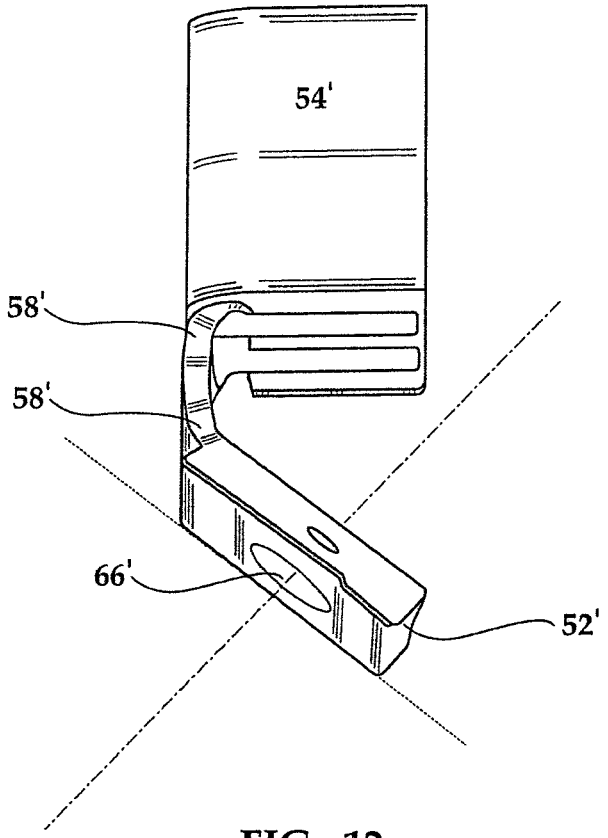
FIG. 12 is an enlarged isolated side perspective view of an anchor having an angled base as introduced in FIG. 10, the rake shoe for the anchor having an angled base being substantially similar to the rake shoe as introduced in FIG. 3.

Turning now to FIG. 12, there is shown an isolated view of one embodiment of anchor 54' having an angled base 52'. As previously discussed above with respect to FIG. 8A, anchor 54' may also include an anchor chamber 64' that is generally sized and arranged to accept and secure baluster 18, or the like. Anchor chamber 64' may include at least one open face, for example an installation face to allow access and positioning of baluster 18, or the like. Similarly, anchor 54' may have a generally U-shaped upper body section and a flat lower face that may be positioned and engaged on a tread, or the like. Similarly, anchor 54' may have an open boxed shaped cross-section. As previously discussed above with respect to FIG. 8A, mounting void 66' may be positioned on the bottom face of anchor 54' and may be attached with a wood screw, molly bolt or similar fastener to the top surface of a kneewall or the like.

The angled base may further include at least one relief 58', which may be a pair of opposed notches, centered hole or crease to allow the angled base to bend to conform to the angle of the top surface of the kneewall. This allows the anchor 54' to have strength but also the ability to bend thereby adjusting the rake angle in order that the baluster is vertical. In addition, mounting void 66' is located to line up directly below the center of the hole in the handrail. Also, the position of the mounting void 66' allows the fastener 68 to be put in perpendicular to the top surface of the kneewall rather than at an angle thereby improving the ease of installation since the fastener is less likely to "walk" when being installed. Finally, the thickness of the angled base may be increased by welding an additional metal plate on the bottom of the rake anchor thereby further increasing holding strength.

As also discussed above, in additional embodiments, this disclosure also includes a renovation or retrofit kit. In certain examples of this embodiment, the kit may include at least one upper rake anchor 40 and at least one lower rake anchor 40', e.g. any of the rake anchors previously shown or described. The kit may further include at least one baluster 18, e.g. any of the balusters previously shown or described. Other embodiments may incorporate existing balusters. Typically, these kits include materials for assembling, retrofitting or otherwise renovating an existing stairway system, and a baluster assembly in particular, as described above.

In one embodiment operation for installation on a kneewall, the process is similar to installation on an open tread except there is no plughole. Instead, the anchor having an angled base is used. Once all the balusters have been removed, the anchors are installed as follows, starting at the bottom of the stairs. The open side of the U-shaped anchor having an angled base is positioned to face up the stairs. A plumb line is dropped from the center of the hole in the bottom of the handrail and a mark is made on the top surface of the kneewall. A wood screw or similar fastener is inserted into the anchor and the screw is started into the mark. The screw is then tightened securely. A molly bolt can also be used if additional strength is desired. The angle of the anchor can be adjusted using a pair of pliers. The installer then continues up the stairs until all the anchors have been installed.

Next, the installer again first measures from the inside of the anchor to the lower side of the hole in the bottom of the handrail. Then, the installer transfers this measurement from the shoulder of the baluster and mark the length. The baluster again is cut with a hacksaw or a power miter box with a metal abrasive cut off blade.

The installer now slides the upper rake shoe on the top of the baluster with the setscrew facing the same side as the one on the lower rake shoe. The installer places the adapter on the top of the baluster above the upper rake shoe.

Starting from the bottom of the stairs, the installer picks the assembly up and slides the lower rake shoe up a few inches from the bottom of the baluster in order to be able to slide the baluster into the anchor. The side of the lower rake shoe with the setscrew should face up the stairs so the setscrew will not be noticeable in the final installation. The installer slides the top of the baluster with the adapter on top into the hole in the bottom of the handrail and swings the bottom of the baluster into the anchor.

Once in place, the lower rake shoe is lowered down over the anchor. If needed, the installer can push the baluster up slightly so the baluster shoulder is up to the rail on the lower side. The setscrew is now tightened on the lower rake shoe. The installer next pushes the upper rake shoe up against the bottom of the handrail, adjusts the top lines up with the handrail and tightens the other setscrew. The installer repeats this process for the next baluster and works up the stairs. Other embodiments include other variations of operations as described above.

Figure 13A:
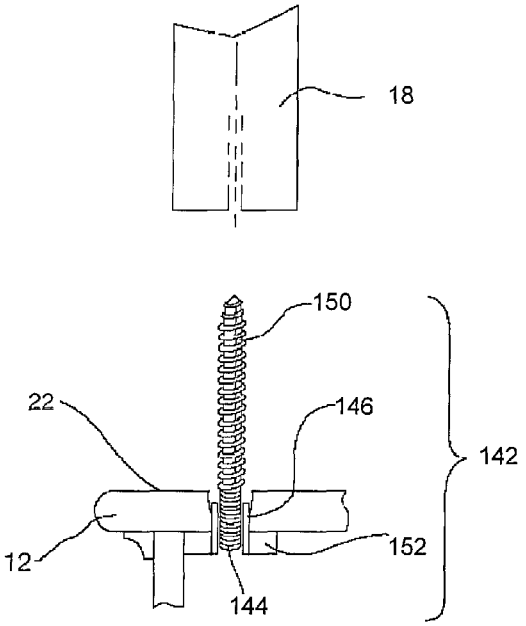
FIG. 13A is an anchoring system according to one embodiment of the present inventions showing it tread mounted.

In creating the stairway system 10 of the present inventions, it is advantageous to anchor it to various portions of a structure. FIG. 13A depicts the anchoring of a lateral support, for instance baluster 18, to a tread 12 by means of an anchor 142. In this case, the anchor 142 includes a bolt 144, a plate 152, a mounting column 146 which is in communication with the plate 152 to create a biasing of the plate 152 against the bottom of the tread 12, and the bolt 144 has on its other end a wood screw 150 which engages the lateral support 18 to create a good firm attachment of the staircase to the tread 12.

Figure 13B:
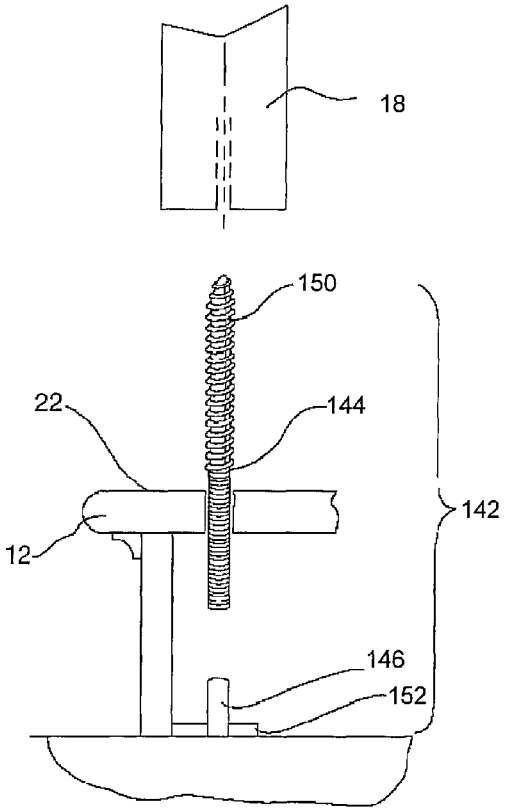
FIG. 13B is the anchoring system of FIG. 13A showing it floor mounted.

An alternative method of using the anchor 142 is as shown in FIG. 13B. In this case, the plate 152 including the mounting column 46 is fastened to the floor and the bolt 144 has a length such that it can extend through the tread 12 into the mounting column 146 over the riser height. Then the wood screw end 150 engages the lateral support, for instance baluster 18.

Figure 14:
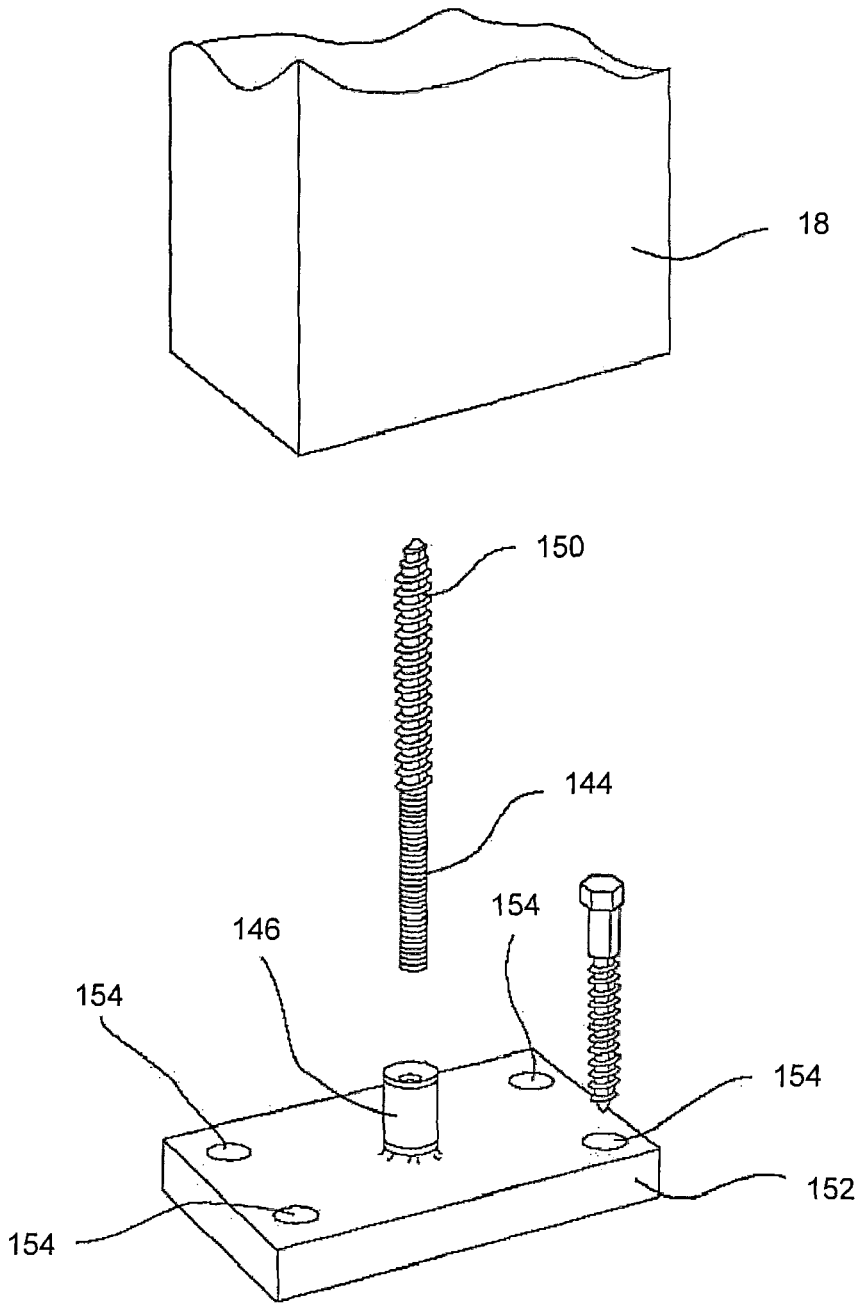
FIG. 14 is an exploded view of the anchor system of FIGS. 13A and 13B.

A more detailed drawing of the flexible anchor 142 is shown in FIG. 14. Here it is seen that the plate 152 can include apertures for attaching the plate 152 either to the floor by use of for example, a fastener such as a wood bolt, or alternatively to the bottom of a tread 12. Again, there is the bolt 44 that engages the mounting column 46 and a wood screw end 150 that engages the lateral support, for instance baluster 18. Although not depicted in FIG. 14, there could be a tread 12 placed between the lateral support, for instance baluster 18 and the plate 152 and as previously described the plate 152 can either be in contact with the tread 12 or mounted directly to the floor.

Certain modifications and improvements will occur to those skilled in the art upon a reading of the foregoing description. For example, other methods may be available for anchoring the stairway system 10 including a variety of French curve-shapes, and the like, on rake anchors to match a variety of angles of angled support surfaces. Further, the newel post fastener system may have a bolt extending into the newel and a access hole and with a threaded sleeve into which a nut may be inserted (see e.g., part #3072 available from Crown Heritage Stair Systems of North Wilkesboro, N.C., the subject matter of which is hereby incorporated herein in its entirety). Also, while wood screws are generally used to attach the anchors to the tread and kneewall, other fasteners such as molly bolts can also be used if the plughole is damaged or additional strength is desired. Finally, while a pair of opposed relief notches are shown in FIG. 12, other forms of relief including a centered hole or crease may be used to allow the angled base to be bent when desired. It should be understood that all such modifications and improvements have been deleted herein for the sake of conciseness and readability but are properly within the scope of the following claims.

I claim:

1. A kit for a baluster assembly for a stairway system having a plurality of spaced apart treads, at least one one-piece baluster per tread and a handrail, said kit comprising:

(a) a rake anchor attached to said one-piece baluster and adapted to abut an angled support surface of said handrail adjacent to one end of said baluster; said rake anchor including:

(i) a generally inverted cup-shape adapter inserted into a hole in the bottom of said handrail, said adapter receiving one end of said one-piece baluster, wherein said one end of said one-piece baluster extends through said rake anchor and into said adapter, whereby said one end of said one-piece baluster is directly secured by said adapter in the hole in the bottom of said handrail without an additional fastener;

(ii) a rake shoe adapted for concealing the interface between said rake anchor and the angled support surface of said handrail, said rake shoe fastened to said rake anchor such that said rake shoe pivots about the rake anchor to match with the angled pitch of said support surface of said handrail; and (b) an anchor assembly including an anchor having at least one open side face adapted to be attached to the top surface of a tread for receiving the other end of said one-piece baluster.

2. The baluster assembly according to claim 1, wherein said anchor is adapted to receive the other end of said baluster on its installation face.

3. The baluster assembly according to claim 2, wherein said anchor is generally U-shaped.

4. The baluster assembly according to claim 3, wherein said anchor is an open boxed shaped cross-section.

5. The baluster assembly according to claim 1, wherein said anchor further includes a base and a fastener for attaching said base to the top surface of a tread.

6. The baluster assembly according to claim 5, wherein said base is convex-shaped to be received by a pre-existing plughole in said tread thereby self-aligning within said pre-existing plughole.

7. The baluster assembly according to claim 5, wherein said anchor assembly further includes a shoe adapted for concealing the interface between said anchor and said other end of said baluster attached to said tread.

8. The baluster assembly according to claim 1, wherein the upper surface of said rake anchor forming the interface between said rake anchor and the angled support surface of said handrail is French curve-shaped for pivoting with respect to the angled support surface of said handrail.

9. The baluster assembly according to claim 1, wherein said anchor further includes an angled base and a fastener for attaching said angled base to the top surface of a kneewall.

10. The baluster assembly according to claim 9, wherein said angled base further includes at least one relief to allow said angled base to bend to conform to the angle of the top surface of said kneewall.

11. The baluster assembly according to claim 9, wherein said anchor assembly further includes (i) at least one rake anchor adapted to abut said kneewall adjacent to said other end of said baluster and (ii) a rake shoe adapted for concealing the interface between said rake anchor and said other end of said baluster attached to said kneewall.

* * * * *